US007380390B1

(12) United States Patent
Brassfield

(10) Patent No.: US 7,380,390 B1
(45) Date of Patent: Jun. 3, 2008

(54) STEP UP STIRRUP

(76) Inventor: Blaine Brassfield, 14794 N. Bank Rd., Roseburg, OR (US) 97470

( * ) Notice: Subject to any disclaimer, the term of this patent is extended or adjusted under 35 U.S.C. 154(b) by 0 days.

(21) Appl. No.: 11/706,673

(22) Filed: Feb. 13, 2007

(51) Int. Cl.
*B68C 3/00* (2006.01)

(52) U.S. Cl. ..... 54/47

(58) Field of Classification Search ..... 54/47–49, 54/49.5; 403/232.1; 182/92
See application file for complete search history.

(56) References Cited

U.S. PATENT DOCUMENTS

| | | | | |
|---|---|---|---|---|
| 717,850 | A * | 1/1903 | Hey et al. | 54/47 |
| 1,321,653 | A * | 11/1919 | Luttinger | 54/49 |
| 4,761,938 | A * | 8/1988 | Townsend | 54/47 |
| 5,661,957 | A | 9/1997 | Daly | |
| 5,809,754 | A | 9/1998 | Schulte | |
| 6,026,633 | A | 2/2000 | Burke | |
| 6,173,558 | B1 * | 1/2001 | Burke, Jr. | 54/47 |
| 6,688,088 | B1 | 2/2004 | Aweeka | |

FOREIGN PATENT DOCUMENTS

| | | | |
|---|---|---|---|
| FR | 2258772 | A * | 9/1975 |
| FR | 2753962 | A1 * | 4/1998 |
| FR | 2880340 | A1 * | 7/2006 |

* cited by examiner

*Primary Examiner*—Son T. Nguyen
(74) *Attorney, Agent, or Firm*—Teri G. Andrews

(57) ABSTRACT

An extendable stirrup has a main stirrup and a retractable step parallel to and slideably attached to the main stirrup. The retractable step has an upper lift portion and a lower step portion. A latch holds the retractable step in the retracted position for riding. For mounting, the user releases the latch thereby allowing the retractable step to automatically descend to an extended position. The user places a foot on the lower step portion of the retractable step to assist in mounting a saddled animal. After mounting the saddled animal, the user engages the upper lift portion with his boot and raises the retractable step to a retracted position whereby the latch holds the retractable step in the retracted position adjacent to the main stirrup.

16 Claims, 3 Drawing Sheets

100
102
104
106
108
109
110
112
114
116
118
120
202
302
304
306
308
310

102
104
106
108
110
120
310
500
502
504
506
602
604
702
802
9

STEP UP STIRRUP

BACKGROUND OF THE INVENTION

1. Field of the Invention

This invention relates primarily to the area of equestrian activities and the general area of safe horsemanship. More specifically, it is directed toward a device for enhancing a horseman's ability to more easily mount a four legged animal such as a horse.

2. Prior Art

The purpose of the traditional saddle stirrup is to aid the horseman in mounting a horse and getting into the saddle. It functions by loosely, but securely, hanging vertically lower than and in line with the position of the horseman's legs when in the saddle. This provides both a means for the horseman to step up into the saddle and a means for the horseman to support and balance their self when in the saddle. Additionally, once the horseman is in the saddle, the stirrup provides the horseman with a means of balance and stability while riding the horse.

For various reasons, a person often has difficulty mounting a horse. The primary difficulty is that a person must step very high in order to place their foot into the stirrup. Shorter people usually have the greatest difficulty because they must step proportionately higher than taller people and this disparity is even greater when the horse is a taller horse.

Often riders must find some sort of aide such as standing on a stool, a rock, a fence, or anything that they can stand on to shorten the step they have to take in order for them to get their foot into the stirrup. This can be both problematic and a safety hazard. Most often there are no aiding devices available at the time and place that the rider needs them. On a trail ride, for example, one cannot always find something of the right height to stand on. It is a safety hazard because random aiding devises are not typically very solid and may tend to move when mounting the horse. Additionally, a horse is often nervous and fidgety when being asked to stand still next to an inanimate object while being mounted. This is sometimes a hazardous situation.

Horse saddle stirrups are historically designed to be attached to a saddle and held in place by a leather strap. This strap is typically adjustable to accommodate different leg lengths or preferences of riders. Typically the desired length of the stirrup strap while riding in the saddle is too high for the rider to comfortably step up to mount the horse. An adjustment to the length of the stirrup strap to minimize the step up requires the rider to be dismounted. Unfortunately, once adjusted the height is fixed and now the rider must ride with a stirrup well below his foot.

Prior art includes a somewhat retractable device disclosed in U.S. Pat. No. 6,688,088 issued to Aweeka. Aweeka discloses a device that assists a rider by providing a lowered step to insert the right foot into and then the left foot is inserted into the riding stirrup in a manner similar to the steps of a ladder. Although this device can be of assistance to the rider in mounting a horse, it is cumbersome and leaves part of the device hanging below the stirrup where it is exposed to other objects such as brush or low lying limbs of a tree that may snag it or, in some cases, it could be something the horse or the rider could possibly become entangled in. This is an unacceptable risk level for the trail rider or any riding that takes place outside of the safe confines of the clinical setting of a professional arena.

Another device disclosed in U.S. Pat. No. 6,026,633 issued to Burke is a stirrup device that "includes a crossbar, a first U-shaped member, a second U-shaped member slidably connected to the first U-shaped member and a retraction mechanism" for facilitating the mounting of a riding animal. This device has a very complicated retraction and retention mechanism that requires a spring latching feature that would easily become non-functional with a minimal amount of dirt and wear. The complication of this device would make it extremely expensive to manufacture.

Another device disclosed in U.S. Pat. No. 5,809,754 issued to Schulte provides an auxiliary mounting step which is pivotal and is generally under and adjacent to the tread of the stirrup. The rider is assisted in mounting the saddle by unfolding and rotating the auxiliary step so it is in a position to provide a step below the stirrup thereby assisting the rider by providing a lower step. This device employs a spring which is very vulnerable to wear and its reliability under heavy use is questionable. Additionally, it is awkward to fold up and even in the retracted or folded position the device cannot be completely out of the way and therefore is exposed to being snagged.

Another mounting device disclosed in U.S. Pat. No. 5,661,957 issued to Daly employs a ratchet assembly mechanism that utilizes a gear rack and spring assembly approach to lower the stirrup for easier mounting. This device does provide the rider with an adjustable height. However, this method leaves an awkward and cumbersome piece of equipment that must be tolerated by both the horse and the rider.

Prior art has, in one fashion or another, attempted to address the issue of providing a device to make it easier for a rider to mount an animal under a saddle. The result, in most cases, has been a device that either compromises the utility, dependability, appearance or level of safety of the traditional western stirrup.

There is a need for a device for assisting in the mounting of a saddled animal, such as a horse, that is simplistic in function for ease of manufacture, dependable, and safe for the rider as well as the animal.

OBJECTS AND ADVANTAGES

It is a primary object of the present invention to provide a device to assist a rider in mounting an animal, such as a horse, under a saddle.

It is another object of the present invention to provide a dependable horse mounting assist device that can be cost effectively manufactured with minimal parts.

It is yet another object of the present invention to provide a horse mounting assist device that does not compromise the safety of either the horse or the rider.

The preferred embodiment of the present invention provides utility by being as adaptable to any western type saddle as any traditional type western saddle type stirrup. It is not only adaptable for use by any rider but also adaptable to any traditional western saddle. Its simple construction makes it cost effective to manufacture while it also provides trouble free operation and a level of dependability comparable to the traditional western stirrup itself. In its retracted position this device is indistinguishable in appearance to the traditional western stirrup.

SUMMARY OF THE INVENTION

The present invention provides a safe, easy to use, and dependable horse mounting assist device that is easily adapted to any traditional western saddle.

The present invention discloses an extendable stirrup that has a main stirrup and a retractable step parallel to and slideably attached to the main stirrup. The retractable step has an upper lift portion and a lower step portion. A latch holds the retractable step in the retracted position for riding. For mounting, the user releases the latch thereby allowing the retractable step to automatically descend to an extended position. The user places a foot on the lower step portion of the retractable step to assist in mounting a saddled animal. After mounting the saddled animal, the user engages the upper lift portion with his boot and raises the retractable step to a retracted position whereby the latch holds the retractable step in the retracted position adjacent to the main stirrup.

BRIEF DESCRIPTION OF THE DRAWINGS

The above description and other objects, advantages, and features of the present invention will be more fully understood and appreciated by reference to the specification and accompanying drawings, wherein.

Figures 1, 2, 3, 4:
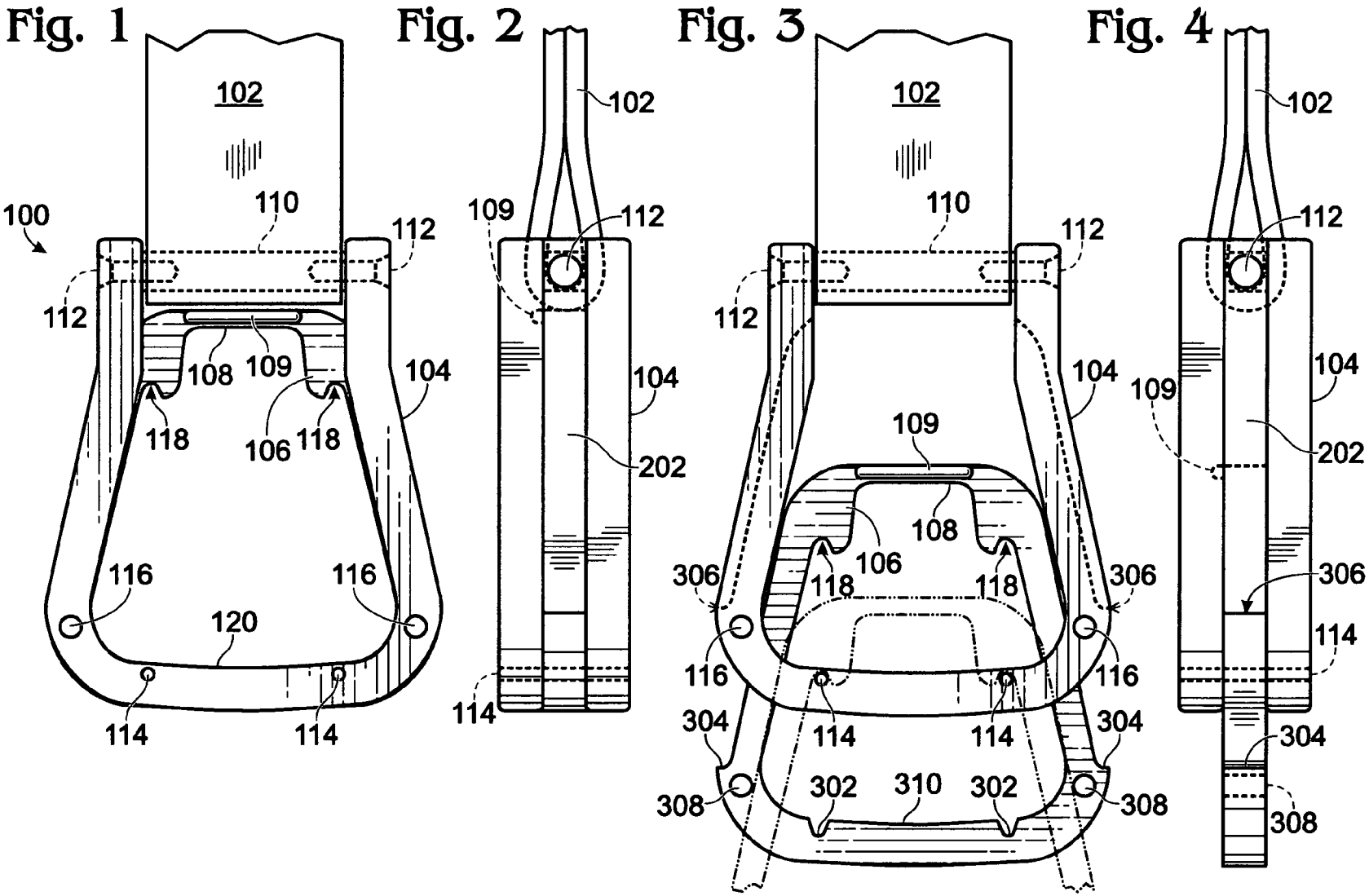
FIG. 1 is a perspective front view of the preferred embodiment of the Step Up stirrup of the present invention with the extendable portion of the stirrup retracted.
FIG. 2 is a perspective side view of the preferred embodiment of the Step Up stirrup of the present invention with the extendable portion of the stirrup retracted.
FIG. 3 is a perspective front view of the preferred embodiment of the Step Up stirrup of the present invention with the extendable portion of the stirrup extended for mounting of a horse.
FIG. 4 is a perspective side view of the preferred embodiment of the Step Up stirrup of the present invention with the extendable portion of the stirrup extended for mounting of a horse.

| DRAWINGS - Reference Numerals | |
|---|---|
| 100 | Step Up Stirrup |
| 102 | Stirrup Strap |
| 104 | Main Stirrup |
| 106 | Stirrup Step |
| 108 | Toe Lift |
| 109 | Toe Catch |
| 110 | Cross Bar |
| 112 | Cross Bar Screw |
| 114 | Retainer Pins |
| 116 | Latching Magnets |
| 118 | Extended Retainer Pin Notches |
| 120 | Boot Rest |

-continued

| DRAWINGS - Reference Numerals | |
|---|---|
| 302 | Retracted Retainer Pin Notches |
| 304 | Stirrup Step Stop |
| 306 | Spacer Base |
| 308 | Step Magnets |
| 310 | Mounting Step |
| 500 | Alternate Step Up Stirrup |
| 502 | Mechanical Latch |
| 504 | Pivot Pin |
| 506 | Engagement End |
| 602 | Stirrup Step Catch |
| 604 | Stirrup Step Channel |
| 702 | Release End |
| 802 | Toe Lift Slot |
| 902 | Latch Spring |

DETAILED DISCUSSION OF THE DRAWINGS

Referring to the figures, like elements retain their indicators throughout the several views.

FIG. 1 is a perspective front view of the preferred embodiment of Step Up Stirrup 100 with Stirrup Step 106 retracted. Step Up Stirrup 100 is attached to a saddle (not shown) by Stirrup Strap 102 wrapped around Stirrup Cross Bar 110 (in phantom). Cross Bar 110 is held in place by Cross Bar Screws 112 extending through Stirrup Spacer 202 (not shown) and screwed into either end of Cross Bar 110. Although FIG. 1 depicts Cross Bar 110 being held in place by Cross Bar Screws 112, it has been contemplated that Cross Bar Screws 112 can be eliminated and Cross Bar 110 can be integrated with Stirrup Spacer 202 (not shown) forming one continuous part with Cross Bar 110.

Step Up Stirrup 100 is held in the shown retracted position by Magnets 116 located on Main Stirrup 104 and in alignment Step Magnets 308 (not shown) located on adjacent portions of Stirrup Step 106. Magnets 116 can be located in various locations along Main Stirrup 104 and Stirrup Step 106 as long as they are located in a location that will secure Stirrup Step 106 in the retracted position when not being used. In the preferred embodiment, two Magnets 116 of opposite polarity are used to secure Stirrup Step 106 in place—one polarity on Main Stirrup 104, the opposite polarity on Stirrup Step 106. More Magnets 116 in multiple locations can be used to add more retention ability for Stirrup Step 106 when in the retracted position. It has also been contemplated to hold Stirrup Step 106 in place by using one Magnet 116 on Main Stirrup 104 with the opposite component being either Stirrup Step 106 itself or a metal pin made from a ferrous metal composition, such as steel. For example, if Stirrup Step 106 is plastic, then there would be either magnets or ferrous pins inserted in positions adjacent to Magnets 116 for holding Stirrup Step 106 in the retracted position.

In the preferred embodiment, Main Stirrup 104 and Stirrup Step 106 are aluminum. However, the components of Step Up Stirrup 100 can be of any material or a combination of material such as aluminum, iron, steel, wood, plastic, or plastic like material that has sufficient strength, rigidity, and toughness characteristics necessary to function as a stirrup.

Retainer Pins 114 act as both retainers and guides to hold Stirrup Step 106 securely in place when in the retracted position as well as in the extended position (discussed in detail in FIG. 3 discussion). Upper Retainer Pin Notches 118 rest on Retainer Pins 114 when in the extended position keeping Stirrup Step 106 stable while mounting the horse. In the preferred embodiment, Upper Retainer Pin Notches 118 are notches on the upper portion of Stirrup Step 106 that mate up with Retainer Pins 114 when Stirrup Step 106 is dropped to the extended position. It has also been contemplated that Upper Retain Pin Notches 118 is not notched but a flat shoulder that rests on Retainer Pins 114 when Stirrup Step 106 is in the extended position.

The upper portion of Stirrup Step 106 includes Toe Lift 108 that is shaped to be contacted by the rider's boot toe. Toe Catch 109 is a portion of Toe Lift 108 that extends perpendicular to Stirrup Step 106 to further assist in catching the rider's boot toe. In the preferred embodiment, the overall shape of Step Up Stirrup 100 is generally trapezoidal but can be of any geometrical configuration that allows sufficient room to encircle or enclose a foot or boot toe while riding or mounting the horse. Although the preferred embodiment depicts Toe Lift 108 as having straight edges, another embodiment has been contemplated where the sides of Toe Lift 108 are rounded to accommodate larger boot sizes or preferred differences in the esthetics of the stirrup design. Toe Lift 108 could also be triangular in shape. It should also be noted that in the preferred embodiment Stirrup Step 106 is one continuous part, is slideably attached to Main Stirrup 104, and has no rigid connection to Main Stirrup 104.

FIG. 2 is a perspective side view of Step Up Stirrup 100 of the preferred embodiment of the present invention with Stirrup Step 106 of Step Up Stirrup 100 retracted.

In the preferred embodiment, Step Spacer 202 is disposed between the two halves of Main Stirrup 104 to increase the rigidity of Step Up Stirrup 100 and the uniformity of the space for Stirrup Step 106. Uniformity of the space that Stirrup Step 106 travels within adds to the smooth travel of Stirrup Step 106 between the retracted and extended positions.

Retainer Pins 114 are shown in phantom extending through both halves of Main Stirrup 104 and the space created by Step Spacer 202. Retainer Pins 114 also contribute to the rigidity of Step Up Stirrup 100 as well as maintain the space between the two halves of Main Stirrup 104 necessary for the travel of Stirrup Step 106. Cross Bar Screw 112 is shown screwed or affixed in the upper portion of Step Spacer 202.

FIG. 3 is a perspective front view of the Step Up Stirrup 100 of the preferred embodiment of the present invention with Stirrup Step 106 partially extended (fully extended in phantom) for mounting of a horse or other saddled animal. Stirrup Step 106 has Lower Retainer Pin Notches 302 disposed on either side of Mounting Step 310. Lower Retainer Pin Notches 302 fit securely around Retainer Pins 114 when Stirrup Step 106 is in the retracted position keeping Stirrup Step 106 from moving around while in the retracted position. For additional stability, Step Spacer 202 (shown in phantom) has Spacer Base 306 which contacts with Stirrup Step Stop 304 when Stirrup Step 106 is in the fully retracted position.

When Stirrup Step 106 is in the fully extended position (shown in phantom), Upper Retainer Pin Notches 118 rest on Retainer Pins 114 keeping Stirrup Step 106 stable while the rider mounts the saddled animal.

Step Magnets 308 are shown on Stirrup Step 106 disposed near Stirrup Step Stop 304. When Step Up Stirrup 100 is in the retracted position Step Magnets 308 align with Magnets 116 on Main Stirrup 104 holding Stirrup Step 106 in the retracted position.

FIG. 4 is a perspective side view of Step Up Stirrup 100 of the preferred embodiment of the present invention with Stirrup Step 106 of Step Up Stirrup 100 partially extended. FIG. 4 illustrates the position of Step Spacer 202 between the two halves of Main Stirrup 104 as Stirrup Step 106 is lowered toward the extended position. Although Main Stirrup 104 is shown in the preferred embodiment as being two separate halves for simplicity of manufacturing, it has also been contemplated that it could be one piece with a disposed slot for Stirrup Step 106.

Figures 5, 6, 7, 8:
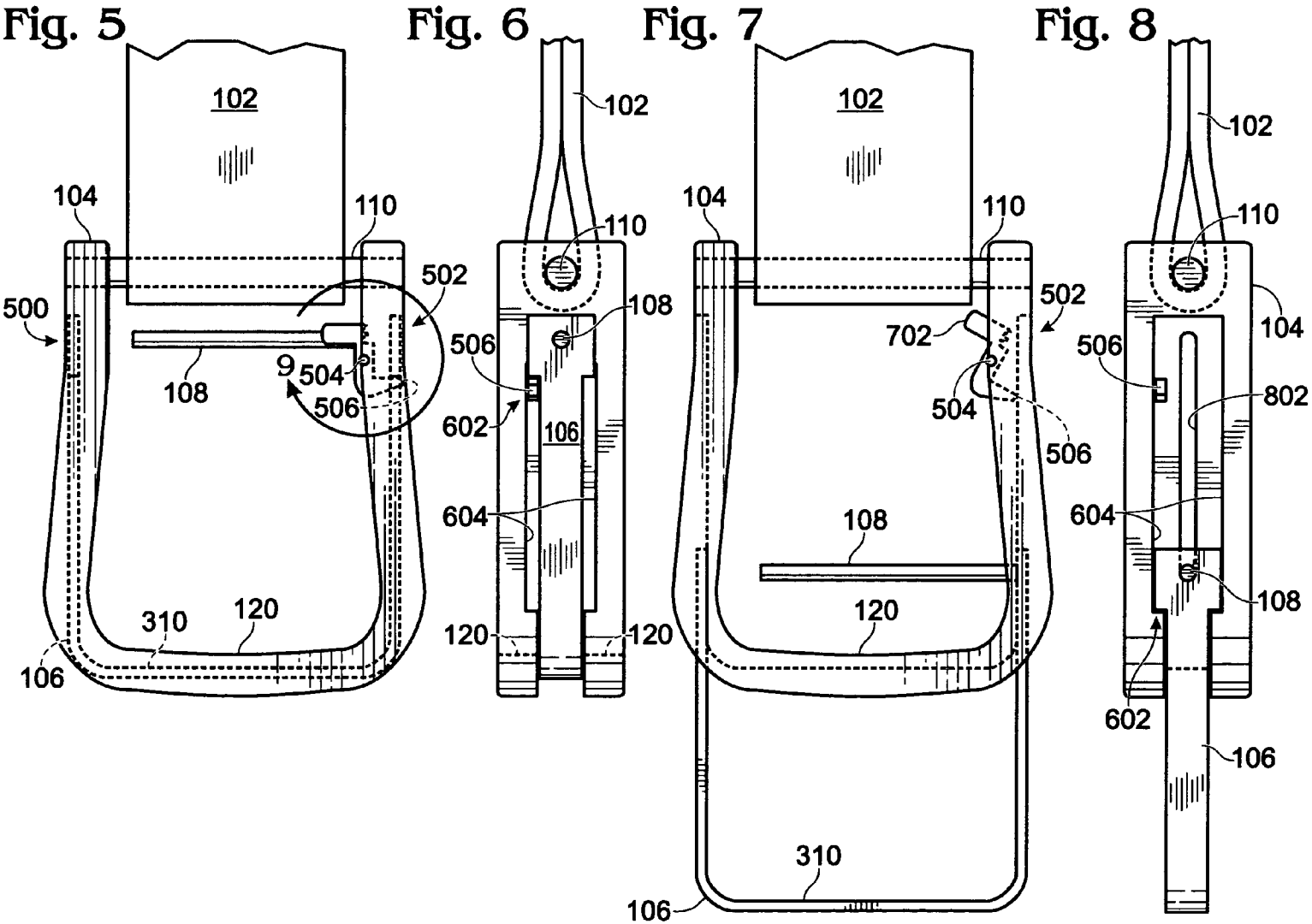
FIG. 5 is a perspective front view of an alternate embodiment of the Step Up stirrup of the present invention with the extendable portion of the stirrup retracted.
FIG. 6 is a perspective side view of an alternate embodiment of the Step Up stirrup of the present invention with the extendable portion of the stirrup retracted.
FIG. 7 is a perspective front view of an alternate embodiment of the Step Up stirrup of the present invention with the extendable portion of the stirrup extended.
FIG. 8 is a perspective side view of an alternate embodiment of the Step Up stirrup of the present invention with the extendable portion of the stirrup extended.

FIG. 5 is a perspective front view of Alternate Step Up Stirrup 500 of an alternate embodiment of the present invention with Stirrup Step 106 retracted. This alternate embodiment employs Mechanical Latch 502 (shown in phantom) to maintain the retracted position of Stirrup Step 106. Mechanical Latch 502 rotates between a locked position and a release position at Pivot Pin 504. Engagement End 506 of Mechanical Latch 502 catches in Catch Portion 602 (not shown) of Stirrup Step 106.

Main Stirrup 104 is constructed as a single component with Cross Bar 110 at the top of Main Stirrup 104. Stirrup Step 106 is disposed within a slot in Main Stirrup 104 and parallel Main Stirrup 104. Cross Bar 110 adds strength and rigidity to Main Stirrup 104 and also provides the means for Alternate Step Up Stirrup 500 to attach to the saddle via Stirrup Strap 102. Alternately, Cross Bar 100 can be an integral part of Main Stirrup 104.

FIG. 6 is a perspective side view of Alternate Step Up Stirrup 500 of the present invention with Stirrup Step 106 retracted. Engagement End 506 of Mechanical latch 502 is shown latched in Stirrup Step Catch 602 thereby securely holding Stirrup Step 106 in the retracted position. Stirrup Step Channel 604 is shown disposed in the side of Main Stirrup 104 so that Stirrup Step 106 does not extend beyond the outer perimeter of Alternate Step Up Stirrup 500. It has been contemplated that a leather wrap or other covering that coordinates with the attached saddle cover the exterior of Alternate Step Up Stirrup 500 thereby protecting sliding Stirrup Step 106. The base of Stirrup Step Channel 604 also limits the travel of Stirrup Step 106 by decreasing in width before Stirrup Step 106 can drop below the base of Alternate Step Up Stirrup 106.

FIG. 7 is a perspective front view of Alternate Step Up Stirrup 500 of the present invention with Stirrup Step 106 extended for mounting a saddled animal. When Release End 702 is pressed upward, Mechanical Latch 502 pivots about Pivot Pin 504, and Engagement End 506 is retracted from Stirrup Step Catch 602. When released, Stirrup Step 106 drops via gravity and the weight of Stirrup Step 106 to the extended position. The rider then places their boot or shoe on Mounting Step 310 to step up and mount the saddled animal. As shown in FIG. 7, Toe Lift 108 is a straight bar that in the extended position enough space is left for the toe of the rider's boot or shoe to catch under it for lifting and returning Stirrup Step 106 to the retracted position. It has also been contemplated that Toe Lift 108 could have a curvature or other angle that would suit the engagement of a rider's boot or shoe necessary to pull Stirrup Step 106 back up to the retracted position.

FIG. 8 is a perspective side view of Alternate Step Up Stirrup 500 of the present invention with Stirrup Step 106 extended. FIG. 8 further illustrates Stirrup Step 106 as the end of Toe Lift 108 slides through Lift Slot 802. When Stirrup Step 106 is extended, the wider portion of Stirrup Step 106 is stopped by the narrow portion of Main Stirrup 104.

Figure 9:
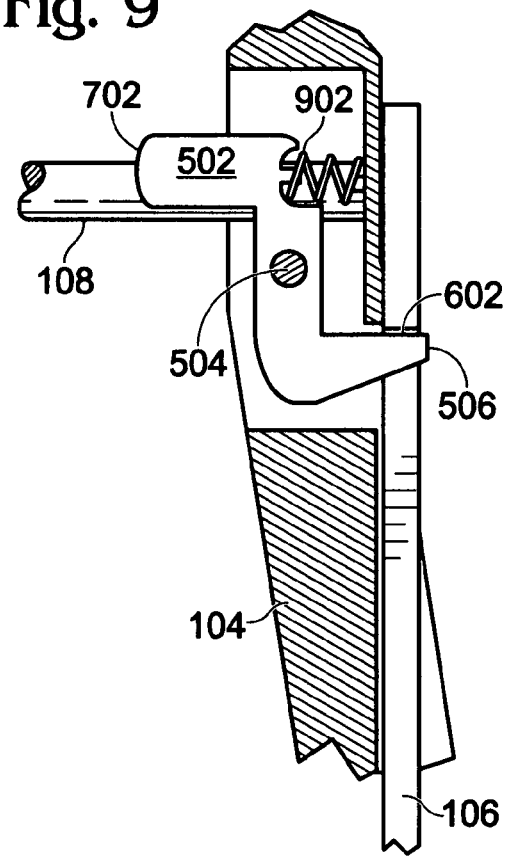
FIG. 9 is a detailed view of the latching mechanism of an alternate embodiment of the Step Up stirrup of the present invention taken at circle 9-9 of FIG. 5 with the extendable portion of the stirrup retracted.

FIG. 9 is a detailed view of Mechanical Latch 502 of Alternate Step Up Stirrup 500 of the present invention taken at circle 9-9 of FIG. 5 with Stirrup Step 106 retracted. Mechanical Latch 502 has Engagement End 506 extended below Stirrup Step Catch 602 thereby holding Stirrup Step 106 up and in the retracted position. Latch Spring 902 of Mechanical Latch 602 is extended and with its spring force assisting in holding Engagement End 506 outward and under Stirrup Step Catch 602.

Figure 10:
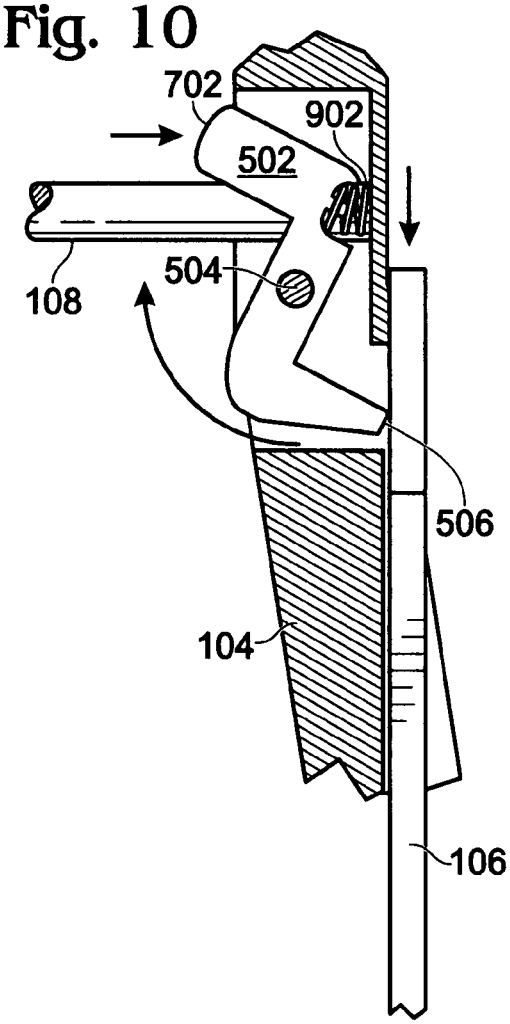
FIG. 10 is a detailed view of the latching mechanism of an alternate embodiment of the Step Up stirrup of the present invention taken at circle 9-9 of FIG. 5 with the extendable portion of the stirrup extended.

FIG. 10 is a detailed view of Mechanical Latch 502 of Alternate Step Up Stirrup 500 of the present invention taken at circle 9-9 of FIG. 5 with Stirrup Step 106 extended. Upon applying upward pressure to Release End 702 of Mechanical Latch 502, Latch Spring 902 is compressed, Mechanical Latch 502 pivots about Pivot Pin 504, and Engagement End 506 is retracted from under Stirrup Step Catch 602 of Stirrup Step 106. Stirrup Step 106 is then released to fall by gravity and its own weight to the extended position for assisted mounting of the horse or other saddled animal. In the extended position, Latch Spring 902 is compressed and keeps Engagement End 506 of Mechanical Latch 502 biased outward. When the rider no longer needs Stirrup Step 106, they simply lift Toe Lift 108 by catching with the tip of their boot or shoe until the spring force of Latch Spring 902 slides Engagement End 506 under Stirrup Step Catch 602 returning and holding Stirrup Step 106 to the retracted position for riding.

Wherein the terms and expressions which have been employed in the foregoing specification are used therein as terms of description and not of limitation, there is no intention, in the use of such terms and expressions, of excluding equivalents of the features shown and described or portions thereof, it being recognized that the scope of the invention is defined and limited only by the claims which follow.

I claim:

1. An extendable stirrup, comprising:

a main stirrup;

a retractable step parallel to and slideably attached to the main stirrup, the retractable step having an upper lift portion and a lower step portion, the upper lift portion having a lift lip extending essentially perpendicular from the upper lift portion;

a latch;

wherein, a user releases the latch thereby allowing the retractable step to automatically descend to an extended position, the user places a foot on the lower step portion to assist in mounting a saddled animal, after mounting the saddled animal, the user engages the lift lip of the upper lift portion with his boot and raises the retractable step to a retracted position whereby the latch holds the retractable step in the retracted position adjacent to the main stirrup.

2. The extendable stirrup of claim 1, wherein the latch further comprises at least one magnet disposed on the main stirrup that is attracted to a magnetic attraction portion on the retractable step.

3. The extendable stirrup of claim 2, wherein the magnetic attraction portion on the retractable step is a second magnet.

4. The extendable stirrup of claim 2, wherein the magnetic attraction portion on the retractable step is a ferrous metal.

5. The extendable stirrup of claim 1, wherein the main stirrup further comprises a first half and a second half parallel to the first half and the retractable step, the first half and the second half are separated by a slot, wherein the retractable step slides within the slot when sliding between the retracted position and the extended position.

6. The extendable stirrup of claim 5, wherein the first half and the second half have at least one retainer pin extending through the slot and fixedly attached to the first half and the second half, wherein when the upper lift portion of the retractable step rests on the at least one retainer pin in the extended position.

7. The extendable stirrup of claim 6, the retractable step further comprising at least one retainer notch disposed on the upper lift portion, wherein, with the retractable step in the extended position, the at least one retainer pin slides into the at least one notch holding the retractable step firmly in place while the user mounts the saddled animal.

8. The extendable stirrup of claim 1, wherein the main stirrup and the retractable step are made of aluminum.

9. The extendable stirrup of claim 1, wherein the main stirrup and the retractable step are made of plastic.

10. The extendable stirrup of claim 1, wherein the main stirrup is made of plastic and the retractable step is made of aluminum.

11. The extendable stirrup of claim 1, wherein the main stirrup and the retractable step are made of steel.

12. The extendable stirrup of claim 1, wherein the main stirrup is made of plastic and the retractable step is made of steel.

13. The extendable stirrup of claim 1, wherein the main stirrup and the retractable step in the retracted position are trapezoidal in shape.

14. The extendable stirrup of claim 1, wherein the main stirrup and the retractable step in the retracted position are oval in shape.

15. The extendable stirrup of claim 1, wherein the main stirrup and the retractable step in the retracted position are rectangular in shape.

16. The extendable stirrup of claim 1, wherein the retractable step is contained within the perimeter of the main stirrup when in the retracted position.

* * * * *